US005123491A

United States Patent [19]

Luchs

[11] Patent Number: 5,123,491

[45] Date of Patent: Jun. 23, 1992

[54] METHOD OF FIGHTING OIL FIRES WITH SAND AND SANDBLASTING

[76] Inventor: Mary N. Luchs, 32 Hayloft Cir., Wilmington, Del. 19808

[21] Appl. No.: 669,986

[22] Filed: Mar. 15, 1991

[51] Int. Cl.[5] ..... A62C 3/00; A62C 3/06; A62C 2/06

[52] U.S. Cl. ..... 169/69; 169/70; 169/46; 169/47; 169/49

[58] Field of Search ..... 169/69, 70, 43, 44, 169/46, 47, 48, 49; 166/292; 252/2

[56] References Cited

U.S. PATENT DOCUMENTS 3,033,291 5/1962 Wieslander ..... 169/47

FOREIGN PATENT DOCUMENTS

| | | | |
|---|---|---|---|
| 47059 | 3/1911 | Austria | 169/69 |
| 647893 | 7/1937 | Fed. Rep. of Germany | 169/49 |
| 952276 | 8/1982 | U.S.S.R. | 169/69 |
| 520969 | 5/1940 | United Kingdom | 169/49 |
| 532971 | 2/1941 | United Kingdom | 169/49 |

*Primary Examiner*—Margaret A. Focarino
*Assistant Examiner*—James M. Kannofsky
*Attorney, Agent, or Firm*—James K. Luchs

[57] ABSTRACT

The application of sand combined with sandblasting extinguishes oil and gas fires by cutting off oxygen, cooling the area and stopping the fuel supply. Sand mixed with soda ash converts to glass to smother high temperature fires. Sandblasting controls flames while a fire is smothered by mounding with sand.

6 Claims, No Drawings

METHOD OF FIGHTING OIL FIRES WITH SAND AND SANDBLASTING

FIELD OF THE INVENTION

The invention relates to a method of extinguishing fires from oil and gas wells and storage and refinery facilities. In particular, the invention employs sand as at least one natural material for extinguishing such fires.

BACKGROUND OF THE INVENTION

Oil and gas fires, especially where the oil and/or gas are under pressure, are difficult to extinguish and involve great risk to the persons who must use explosives in the process. Even when large quantities of water are sprayed to cool the fire, there are considerable risks involved.

Even when, for example, an explosive charge can extinguish the flames by cutting off the supply of oxygen, the metal pipes and surrounding areas are so hot that the fire can restart if the well cannot be capped quickly enough after the blast from the explosion to extinguish the flames. Also, the blast must be of sufficient force to provide an adequate shock wave, but not be so destructive as to prevent the well from being capped.

While cooling water is readily available for oil fires on offshore rigs, there has been a continuing problem of fighting fires in desert regions where tracked vehicles and helicopters are required to even reach the site and water is unavailable.

Summary of the Invention

It is an object of the invention to provide a means of extinguishing oil and gas fires using sand as the means for (1) cutting of the supply of oxygen to the fire (2) lowering the temperature below the ignition point, and (3) shutting off the supply of gas and/or oil.

The process employs contacting a burning oil and/or gas fire with sand in an amount and with a pressure sufficient to interrupt combustion. Sand may be applied to the fire by a variety of means alone or in combination, including dropping from a helicopter or bulldozing, spraying or sandblasting or use of a crane. Sand may be used as the sole material applied or the sand may be mixed with water or other firefighting materials.

In a special case, the sand can be mixed with soda ash to allow the heat of combustion at the well head to convert this mixture to glass and seal the well without requiring close approach to the fire site. In this case, a glass producing composition could be applied using sand blasting in order to provide a positive pressure to supress the flame and oil and/or gas pressure as well as to absorb heat from the pipes and surroundings.

Detailed Description of the Invention

Sand is a readily available and easy to use fire extinguishing material which would not need to be transported to locations where an urgent need exists to employ this technique. While this technique has been known to be the only practical means for dealing with incendiary bombs dropped on civilian homes in wartime, it appears to have been overlooked as a means for dealing with modern terror bombing of oil facilities. Therefore, just as civiians were instructed during World War II to have sand available as a means to smother incendiary bombs dropped by an enemy, it is now possible to place sand banks near oil wells and gas facilities such that in the event of accident or sabotage the sand could be pushed over the area to put out the fire or at least allow the fire to be dispersed and extinguished by more convenient means, such as foam.

As a special security feature, a premixed glass producing mixture containing sand as a principle ingredient could be packed around pipes in water tight packaging. In the event of a high temperature fire, the mixture would be converted to glass and flow into a rupture and stop the fire. Or such a mixture could be positioned directly above a potential fire source such that an actual fire would create a stream of molten glass to flow directly into the source of heat. As a further alternative, the gas or oil could pass through a sand filter below the surface of the sand surrounding the installation so that the sand filter would be converted to a glass well cap in the event of a fire.

In detail, the process of the invention involves using sand which is available directly adjacent to an oil or gas well or facility in a manner which is superior to water and/or explosives. Specific properties of the sand are its ability to be mounded over the burning area in order to smother a fire as well as being able to be sprayed or sandblasted on the fire. Application of the sand as a spray or sandblast stream will allow sand to enter an open or ruptured pipe and break up the flames and remove heat required to restart ignition of the oil or gas.

A stream or spray from, for example, a crane directed into the fire source would be capable of capping the opening at least long enough to put out the fire until sand could be mounded over the area to prevent reignition.

If necessary, a glass forming mixture applied to a very hot fire under pressure can form a in situ cap for an otherwise uncontrollable fire. Drilling a new well might well be a viable option to having a well fore burn for years until the pressure became low enough that conventional means could be used which could allow reusing the well versus the possibility that a well capped with a solidified glass could not be reused.

The present invention has industrial application in oil and gas recovery, refining, storage and transport. The following examples serve to illustrate the practice of the invention.

EXAMPLE 1

A fire in a desert region producing billowing smoke and flames and heat which fuses the surrounding sand into silica requires sand to be mounded on the downwind side by earth moving means until sufficient sand is available to cover the site and extinguish the flames.

EXAMPLE 2

Flame emits from a ruptured pipe located in such a position that sand cannot be used to cover the pipe and smother the flames as in Example 1. This flame is extinguished by directing a high pressure sandblasting stream into the pipe to provide a back pressure adequate to cut off the supply of oxygen to the fire.

EXAMPLE 3

An oil fire is burning in a location where approaching with tracked vehicles might rupture pipes and spread the fire. Sand is dumped on the fire using containers suspended from cargo helicopters until the fire is mounded over with sand.

EXAMPLE 4

A gas well located in a desert region is capped below the surface in an excavation in the sand. Prior to placing a usual delivery valve system on the well shaft, a sand filter encased in a low melting alloy is positioned over the well shaft so that all gas exiting the well must pass through the filter. When all connections have been made and the excavation has been filled in with sand, the heat from an accidental or deliberate fire will convert the sand filter into a fused cap to seal off the gas and extinguish the fire.

EXAMPLE 5

A liquid glass sprinkler system for a capped or producing oil or gas well involves positioning a heat rupturable conical container filled with sand and at least one glass producing material directly over the well head. In the event of a fire of sufficient intensity to produce glass from the ingredients in the conical container, a flow of molten glass will be directed to the fire source in a direct proportion to the intensity of the fire.

EXAMPLE 6

The conical container of Example 5 is positioned over an oil or gas fire and allowed to extinguish the fire and cap the well.

What is claimed is:

1. A method for extinguishing a gas or oil well fire involves the steps of positioning a container of sand and soda ash above a metal pipe of the gas or oil well, converting the sand and soda ash to liquid glass using heat generated by the fire, and extinguishing the gas or oil fire using the liquid glass.

2. The method of claim 1, where the container is conical, where the positioning step further involves positioning the container to allow the liquid glass to flow into the pipe.

3. The method of claim 1, further involving the step of capping the well using the container.

4. The method of claim 1, further involving the step of filtering the gas or oil produced from the well.

5. A method for extinguishing a gas or oil fire from a gas or oil well involves the steps:

(a) storing a supply of sand suitable for use in a sandblasting apparatus and for mounding over the gas or oil well adjacent to the well;

(b) directing a first portion of the supply of sand onto the gas or oil fire using the sandblasting apparatus; and (c) mounding a second portion of the supply of sand over the gas or oil well.

6. The method of claim 5, further involving the step of mixing soda ash with the supply of sand.

* * * * *